US006422822B1

(12) United States Patent
Holmes

(10) Patent No.: US 6,422,822 B1
(45) Date of Patent: Jul. 23, 2002

(54) PRESSURIZED SEAL FOR SUBMERSIBLE PUMPS

(75) Inventor: Jeffrey Wayne Holmes, Anacortes, WA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/594,864

(22) Filed: Jun. 15, 2000

(51) Int. Cl.[7] ..... F04B 49/10; F04B 35/04

(52) U.S. Cl. ..... 417/9; 417/13; 417/423.3; 417/423.11

(58) Field of Search ..... 417/44.1, 423.11, 417/423.3, 9, 13

(56) References Cited

U.S. PATENT DOCUMENTS 3,902,028 A * 8/1975 Tremain ..... 200/81 R
5,796,197 A * 8/1998 Bookout ..... 310/85

* cited by examiner

*Primary Examiner*—Charles G. Freay

(57) ABSTRACT

A submersible pump employs a sealed, oil-filled chamber with a moisture-sensing probe to detect the presence of any pumpage, such as water, which has leaked into the chamber. If contamination is detected, the pump may be shut down for repairs before it fails. Two mechanical seals are installed the lower seal is located between the pump and the oil chamber and an upper seal is located between the oil chamber and the motor. The improvement disclosed herein combines a pressurized oil accumulator with the pump oil chamber described above. The accumulator is divided into two compartments separated by a bladder, one compartment being connected to the reservoir of the pump and filled with oil for providing make-up oil to the reservoir and for accepting surplus (expansion) oil from the reservoir. The second compartment is pressurized and applies pressure to the bladder that, in turn, transfers the pressure to the oil in the first compartment and to the oil-filled chamber. The purpose is to pressurize the pump oil chamber in order to equalize pressure across the seals and thereby prevent failure of the seals or, at least, extend their life. The invention also includes apparatus for purging the motor casing with air and a pressure transducer for detecting a decrease in reservoir oil pressure.

9 Claims, 4 Drawing Sheets

PRESSURIZED SEAL FOR SUBMERSIBLE PUMPS

BACKGROUND OF THE INVENTION

1. Field of the Invention

The invention is directed to submersible centrifugal pumps and to methods and apparatus for providing pressurized sealing of the motors thereby improving their operational life. The invention is particularly applicable and directed to coker maze pumps used in delayed coker processes to recirculate the water from coker maze pits containing coke fines suspended in water, also known as coke-laden fines. The invention may also have application in other submersible pump services, such as water lift stations and sewage treatment plants.

2. Description of Related Art

Prior art submersible pumps employ a sealed, partially oil-filled chamber having a moisture-sensing probe extending into the oil to detect the presence of any pumpage, which may be water or water containing suspended coker fines. If contamination is detected, steps may be taken to protect the motor. Two seals are utilized on the motor shaft, a lower seal located between the pump and the oil chamber (pumpage-seal) and an upper seal located between the oil chamber and the motor (motor-seal).

Prior art submersible pumps use different seal approaches but do not pressurize the seal chamber. One approach employs stacked lip seals. The lip seals run against the shaft and, over time, will fail. The advantage to this approach is that there is some predictability in timing, which allows for scheduled pump maintenance. Another approach is a non-pressurized mechanical seal. Mechanical seals are the norm in the industrial pump industry as they are generally long lasting, but there is no predictability as to their failure. This is generally not a major problem with a non-submersible pump, but with a submersible pump the pumpage often gets into the motor resulting in electrically shorting out the motor.

Prior art submersible motors generally are not designed to withstand internally generated pressure caused by motor winding temperature increase and/or the temperature rise due to the temperature of the pumpage in the sump/storage tank. The motors depend on pressure release via the non-pressurized motor and pump seals to release the generated pressure. If that avenue is not available, pressure is relieved via electrical or instrument fittings, directly into the water pumpage. When the motor shuts down and cools off, the process is reversed with water leaking into the motor. The motor is shorted out and will fail on the next start

SUMMARY OF THE INVENTION

The improvements disclosed herein combine a pressurized oil accumulator in combination with the pump oil chamber described above, and a motor pressure control system.

Pressurized Seal Arrangement

The pressurized oil accumulator in combination with a pump having a submersible motor and pump seals as described herein, can withstand water leakage into the pump and pump motor through the pump and motor mechanical seals. The accumulator is a steel pressure vessel containing a rubber oil bladder. The oil bladder is connected to the reservoir of the pump and is filled with oil for providing make-up oil to the reservoir and for accepting surplus (expansion) oil from the reservoir. The steel shell of the accumulator is pressurized with nitrogen to a pressure higher than the pressure of the pumpage at the pumpage-seal face. The applied pressure in the accumulator pressurizes the pump oil chamber to a pressure equal to the nitrogen pressure in the second compartment. The invention provides the following advantages:

Oil Lubrication of the Seal Faces: Oil pressure in the oil reservoir is maintained higher than the water (pumpage) pressure, therefore the pumpage seal faces are always lubricated by oil, rather than by contaminated water, and any leakage past the seal is from oil to water (pumpage) and not from water to oil. This ensures that water does not migrate into the oil reservoir and into the motor.

Totally Full Oil Chamber: In the prior art, it was necessary to leave expansion room in the oil chamber for oil expansion due to the temperature rise. The improvement of the accumulator tank disclosed herein provides the fluid capacitance to allow for this pressure rise. The oil reservoir is totally filled at all times, keeping the top (motor) seal constantly lubricated.

Accumulator Tank Allows for Pressure Rises: As the pump warms up to operating temperature in the present invention, the bladder in the oil accumulator provides the capacitance to absorb the pressure increase without significantly increasing pressure at the seal faces.

Pressure Pre-Alarm: A pressure switch or transmitter may be installed in the oil chamber to provide a "low pressure" pre-alarm to indicate a fall in oil pressure. This is in addition to the moisture probe that is part of the prior art pump. With this pre-alarm, maintenance is limited to a recharge of the oil system, vs. a complete tear-down of the pump which is ultimately required when water gets into the pump oil chamber.

DESCRIPTION OF PREFERRED EMBODIMENTS

Figure 1:
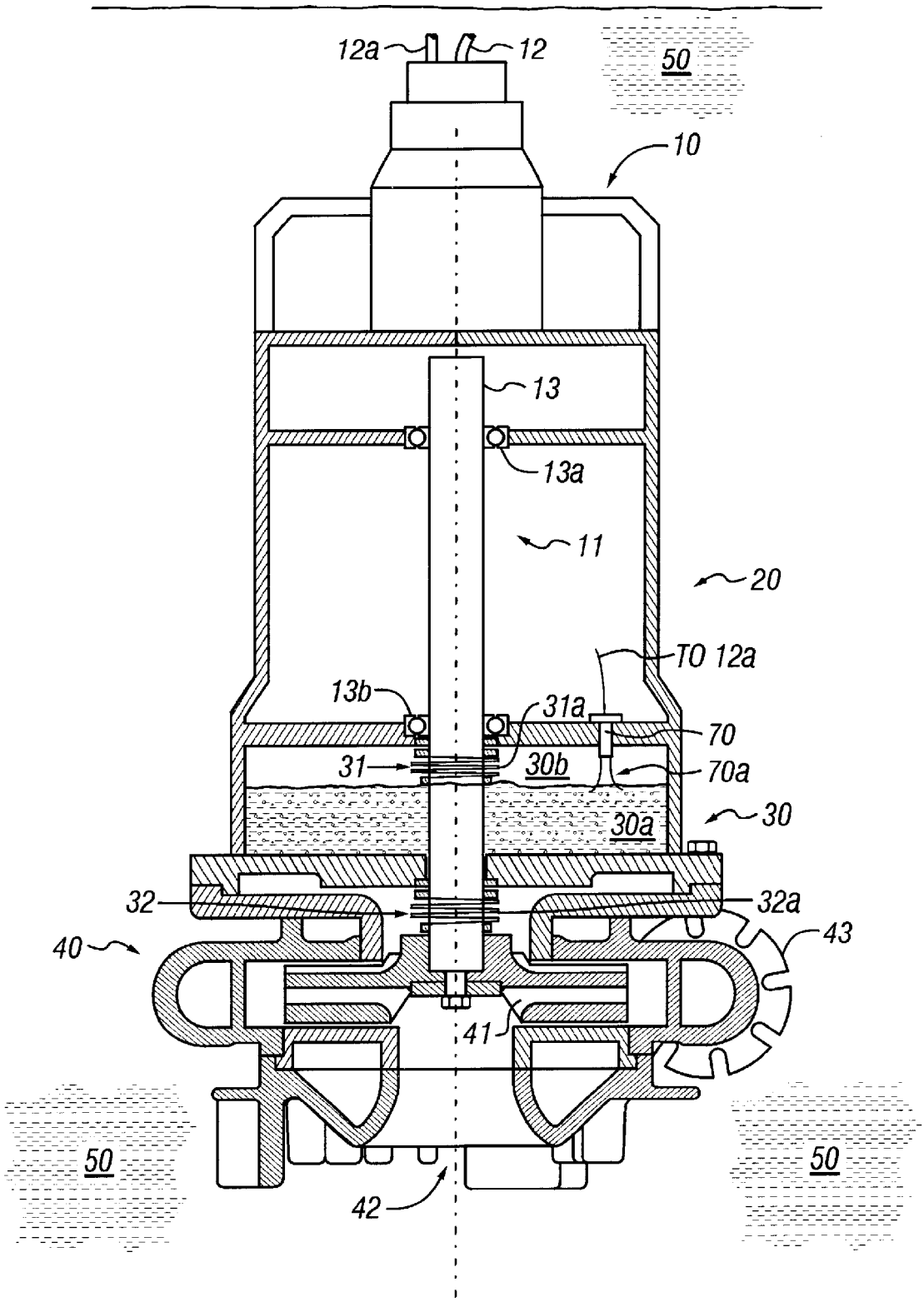
FIG. 1 (Prior Art)
FIG. 1 is a schematic drawing of a prior art submersible pump.

Referring now to FIG. 1, a prior art submersible pump 10 is shown submerged in a fluid 50 (hereinafter referred to as "pumpage" or "pumpage fluid") confined within a sump or storage tank (not shown). The pump 10 comprises a motor section 20, a sealed, partially filled oil reservoir 30 and a pump section 40. The sealed oil reservoir 30 comprises a portion that is partially filled with oil 30*a* and a non-pressurized portion 30*b* above the oil level 30*a*. The motor 11 receives power by means of electrical power cables 12 and drives a motor shaft 13. The motor shaft 13 sealingly extends through the oil reservoir 30 and into the pump section 40 where it is rigidly connected to an impeller 41 so as to cause rotation thereof when motor shaft 13 rotates. The pump section 40 is provided with an inlet (or suction) port 42 for drawing pumpage fluid 50 into the pump in the usual manner, and a discharge port 43 for discharging pumpage fluid 50 from the sump/storage tank and to another location, e.g., at the surface, for treatment and/or reuse. Seals 31 and 32 are Type 21 rubber bellows seals which are well known to those skilled in the art and are designed to fluidly isolate the reservoir 30 from the motor section 20 (seal 31) and from the pump section 40 (seal 32). Each seal 31, 32 utilizes a single coil spring 31*a*, 32*a* to push the faces together. As will be subsequently shown, these seals 31, 32 have not proven to be satisfactory in certain applications.

Oil reservoir 30 includes a first, or upper, motor seal 31 and a second, or lower, pumpage seal 32. Upper seal 31 seals the entrance interface between motor shaft 13 and its entrance from motor section 20 into oil reservoir 30. In like manner, lower seal 32 seals the interface between motor shaft 13 and its exit interface from the oil reservoir 30 to the pump section 40. Motor shaft 13 is supported in the usual manner by bearings 13*a* and 13*b*. It will be appreciated that the motor section 20, the oil reservoir 30 and the pump section 40 are rigidly connected into a single assembly, or pump system 10. Pump system 10 is well known to those skilled in the art and may be purchased as a unit from commercial suppliers.

As shown in the prior art system of FIG. 1, the sealed, partially filled oil reservoir 30 also includes a moisture-sensing probe 70 having sensor leads 70*a* extending into reservoir oil 30*a* for sensing any conductive liquid (pumpage) which may bypass the lower seal 32 and leak into the oil reservoir 30 thereby mixing with the reservoir oil 30*a*. The presence of any conductive liquid is indicative of a seal 32 failure that allows the moisture-sensing probe 70 electrical circuit between the sensor leads 70*a* to be completed by the reservoir oil/water mixture 30*a*. The completion of the probe 70 electrical circuit 70*a* may be used to interrupt the power supply to motor 11 and the motor 11 may then be shut down for repair, thus preventing a burnout of the motor. Upper seal 31 and lower seal 32 are independent mechanical seals designed to give the motor 11 fail-safe protection from the pumped liquid 50. Upper seal 31 may have carbon and ceramic faces. Lower seal 32 faces may be tungsten carbide to provide maximum life in slurry pumping; however, these seals have not proven to be satisfactory in the Applicant's installations.

Figure 2:
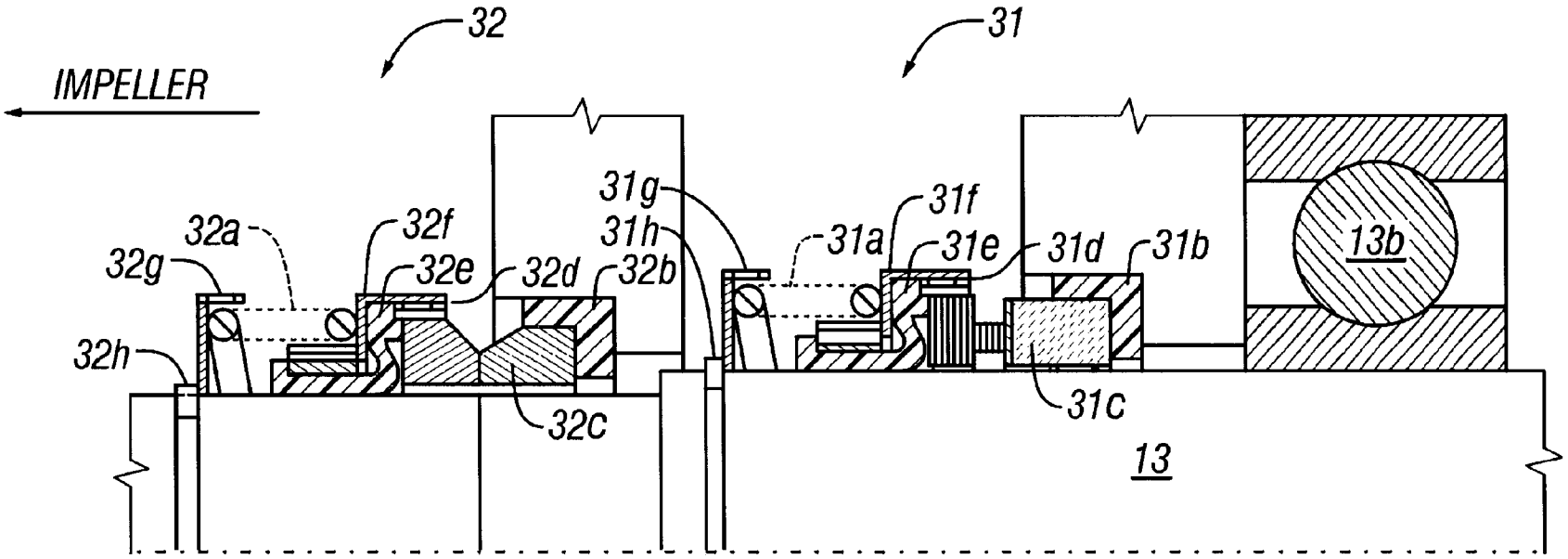
FIG. 2 (Prior Art)
FIG. 2 is a schematic drawing of the seal system of the prior art submersible pump of FIG. 1.

Referring now to FIG. 2, the prior art submersible pump 10 of FIG. 1 utilizes a motor seal 31, referred to in the industry as a rubber bellows seal. Motor lower bearing 13*b* (along with upper bearing 13*a*) supports the motor shaft 13 for rotation in a non-oil filled motor. Stationary face retainer 31*b* (which may be a synthetic elastomer cup or an o-ring) retains and statically seals the stationary seal face 31*c*, which interfaces with rotating seal face 31*d*. Rubber bellows 31*e* is retained by rotating face retainer 31*f*. The rubber bellows provides a static seal to the shaft 13. A single coil spring 31*a* surrounding the shaft 13 is utilized for compressing the mechanical seal faces 31*c* and 31*b* together. Coil spring 31*a* is held in place by spring retainer cup 31*g* and ring clip 31*h*.

The prior art submersible pump 10 also utilizes a rubber bellows pumpage seal 32 of the same general design as the motor seal 31 described above, but with harder seal faces 32*c*, 32*d* to withstand the abrasiveness of the pumpage 50. Other parts of seal 32 correspond to those of seal 31.

In general, the rubber bellows seal 31, 32 is a low cost seal utilized throughout the pump industry. Its disadvantage in the submersible pump 10 for the pumpage seal 32 is the possible washing action due to the rotating face 32*d*, as contained within the rubber bellows 32*e*, not being perfectly aligned, center on center, with the stationary face 32*c*. This is due to the flexibility of the rubber bellows. The resulting misalignment could allow water to migrate into barrier oil across the seal faces. Secondly, the pumpage rubber bellows seal 32 was not able to contain the internal pressure necessary for the pressurized seal improvement disclosed herein. The rubber bellows motor seal 31 was adequate but suffered from the single coil spring 32*a* exerting a non-uniform pressure on the seal face. This made it difficult to conduct low-pressure air checks for motor leaks during the pump assembly process, as air would leak across the seal face.

Figure 3:
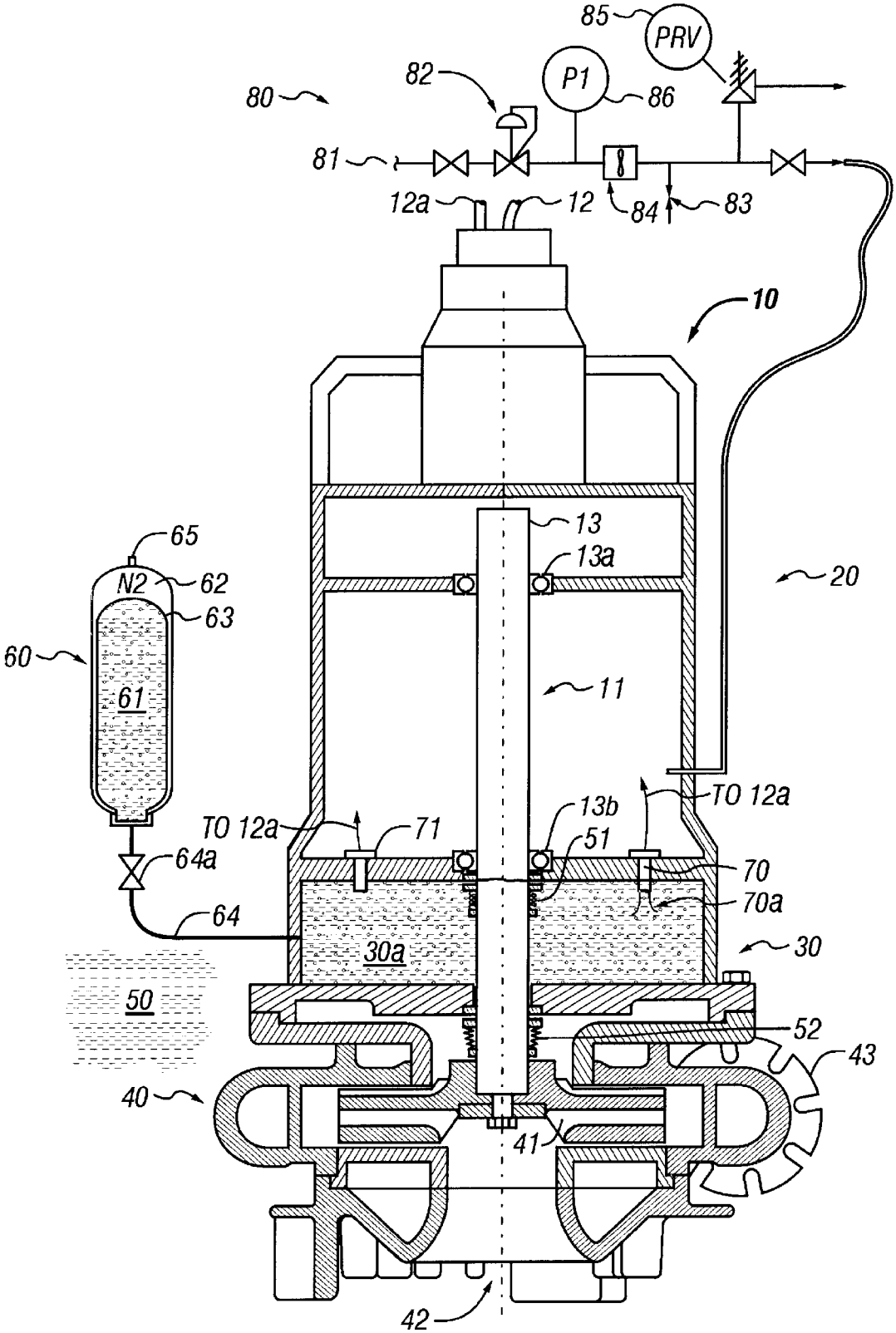
FIG. 3 is a schematic drawing of the prior art pump of FIG. 1, which has been modified by Applicant's invention.

Referring now to FIG. 3, the submersible pump system 10 of FIG. 1 has been modified by the addition of a pressurized accumulator generally designated as 60. Accumulator 60 is divided into two compartments 61, 62 by a bladder 63. Compartment 61 is fluidly connected to oil reservoir 30 and reservoir oil supply 30*a* by a fluid line 64 through valve 64*a*. Compartment 62 is separated from compartment 61 by the bladder 63. Prior to putting the pump 10 into service, oil compartment 61 is topped with oil and compartment 62 is pressurized through Schrader valve 65 by a pressure source (not shown) to a selected pressure, e.g., 35 psig, with nitrogen or other inert gas. Schrader valve 65 is then closed and the pressure source removed. The pump 10 is then ready to be placed in service. The selected pressure in compartment 62 is transferred to the bladder 63 which, in turn, transfers the selected pressure to oil compartment 61 and to oil supply 30*a* through valve 64*a* and fluid line 64 when the selected pressure is greater than the pressure in reservoir 30, i.e., reservoir oil 30*a* pressure. Conversely, when the selected pressure in compartment 62 is less than the pressure in the reservoir 30 (and reservoir oil supply 30*a*), the process reverses and reservoir oil 30*a* pressure is transferred from reservoir 30 and into compartment 61 through fluid line 64 and valve 64*a*. This process equalizes the pressure in oil reservoir 30 and compartments 61, 62 at all times at a pressure which is higher than the pumpage pressure. This ensures that any seal leakage is of reservoir oil 30*a* from oil reservoir 30, across the seal faces and into the pump section 20 (pumpage 50). While the accumulator 60 is shown in FIG. 3 as being located external to the pump 10, it may be located elsewhere within the pump 10 such as, e.g., in the oil reservoir 30. FIG. 3 also includes an improved motor seal 51, an improved pumpage seal 52 and an air purge system 80 as will be described below.

Figure 4:
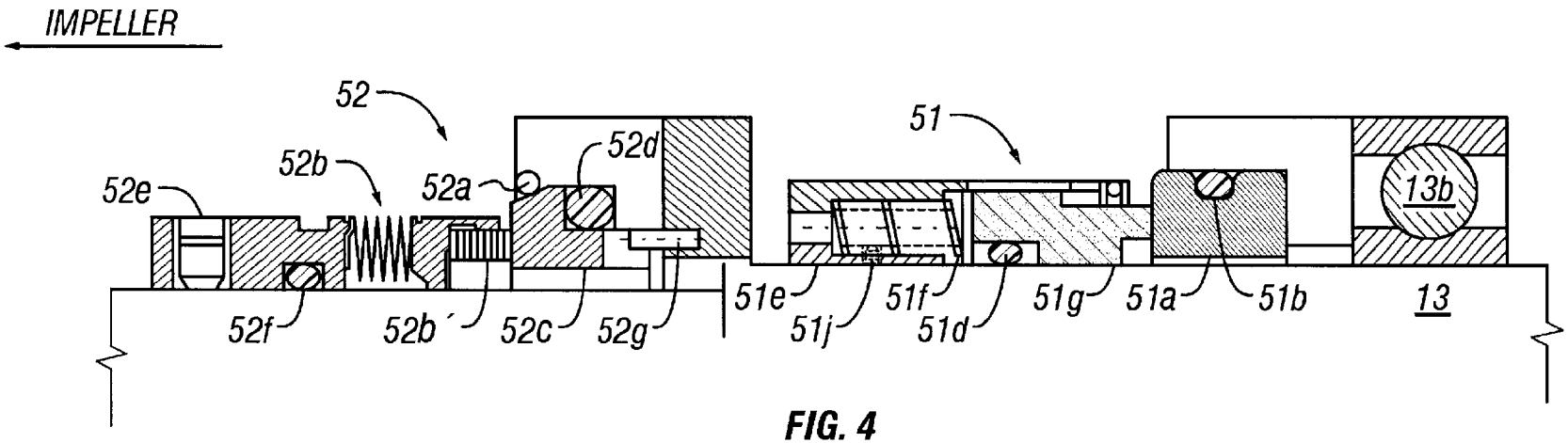
FIG. 4 is a schematic drawing of the improved seal system in the pump of FIG. 3.

Referring now to FIG. 4, the submersible pump system 10 of FIG. 1 has been modified by the replacement of motor seal 31 by a motor seal 51 referred to in the industry as a "pusher seal". The typical pusher seal as detailed in FIG. 4 utilizes a spring pack of, say six to twelve springs 51*f* symmetrically located around the shaft 13 to compress the rotating face 51*g* against the stationary face 51*a* of the seal 51. The springs 51*f* push against the retainer 51*e*, which is locked in place by four setscrews 51*j* into the shaft 13. This gives an even distribution of compression around the seal face over the single coil spring of the prior art and allows the submersible motor to be pressure tested with low pressure during pump build up and repair. The rotating face 51*g* is sealed at the pump shaft 13 by O-ring 51*d*. The o-ring 51*d* is known in the industry as a dynamic o-ring because it moves with the seal 51 on the shaft 13. The stationary face 51*a* is sealed and retained in the lower bearing 13*b* housing by O-ring 51*b*.

As shown in FIG. 4, the pumpage seal 32 of submersible pump system 10 of FIG. 1 has also been replaced by a pumpage seal generally referred to at 52 and referred to in the industry as a "metal bellows seal". Such a seal is inherently better able to align to the stationary face, minimizing washing action. The metal bellows seal 52 is also able to contain internal pressure, once the stationary face is spring clipped in place. It is this property of the metal bellows seal that allows for the pressurization of the barrier oil chamber.

The typical metal bellows seal 52 utilizes a metal bellows 52*b* to compress the rotating face 52*b*' against the stationary face 52*c* of the seal. The metal bellows 52*b* is locked in place by three setscrews 52*e* into the shaft 13. The metal bellows is sealed at the pump shaft 13 by o-ring 52*f*. The o-ring 52*f* is known in the industry as a static o-ring because, once in place, it does not move. The stationary face 52*c* is statically sealed by o-ring 52*d* and clipped in place by retaining ring 52*a*. The retaining ring 52*a* is necessary to hold the stationary face 52*c* in place when the oil reservoir 30 is pressured. A pin 52*g* keeps the face 52*c* from rotating.

Motor Air Purge and Pressure Control

A means of ensuring that the motor does not over-pressure electrical fittings or instrument seals is provided by an air purge directly into the motor as shown at 80 in FIG. 3. A pressure source, such as plant instrument air 81 at about 60 psi, is applied through pressure regulator 82, which may be a Fischer Control Valve regulator, non-bleed off type. A "Continuous Bleed Off Valve" to atmosphere 83 is installed downstream of the regulator 82 to ensure that there is always airflow through the regulator 82. The regulator 82 regulates airflow at about 5 psig. Downstream of the regulator 82 is a rotameter 84 to give an indication of problems, i.e., leaks. Pressure Relief Valve (PRV) 85 protects against regulator 82 failure and is set at about 10 psig. Bleed Off Valve 83 is set to put the rotameter at approximately mid scale. If the rotameter 84 goes to full scale, that would be an indication of a leak in the system (or the motor). If the rotameter 84 goes to zero, that would indicate a problem with the air supply. Pressure Gage 86 is used to monitor and maintain the 5 psig setting from regulator 82. This pressure will be maintained whether the motor is hot or cold and, if a leak does develop, air will flow out, rather than water in and thus protect the motor. Other means and methods known in the industry may be used to regulate and/or control motor pressure, or the effects of motor pressure, such as: designing motor case and electrical and instrument fittings so as to be capable of withstanding expected motor pressure swings; venting motor to surface; and/or installing a submersible motor pressure compensating device such as a pressure compensating bellows or hydraulic ram.

A pressure transducer 71, which may be a pressure switch or pressure transmitter, is also shown in FIG. 3 for sensing the pressure of reservoir oil 30*a*. Transducer 71 is connected to the surface instrumentation (not shown) through instrumentation wiring 12*a* such that oil reservoir pressure may be monitored remotely. A gradual decrease in pressure would indicate a normal leakage of oil across the faces over time. At a preset minimum pressure, the pump could be raised and the oil accumulator recharged with oil and repressured with nitrogen as a routine maintenance. A sudden decrease in pressure of reservoir oil 30*a* would be indicative of a seal failure, especially if the aforementioned moisture-sensing probe 70 also alarms. In either case, the pump would be shutdown for seal repairs, hopefully before motor damage has occurred.

What is claimed is:

1. A submersible pumping system comprising:

an electric motor enclosed in a sealed housing and having a motor shaft;

an oil reservoir rigidly connected to said motor housing and sealingly surrounding a portion of said motor shaft;

a pump rigidly attached to said oil reservoir, said pump including an intake port for receiving a fluid therethrough, an impeller rigidly attached to said motor shaft for rotation therewith and a discharge port for discharging said fluid therethrough;

a first oil seal for fluidly sealing the entrance of said motor shaft into said oil reservoir;

a second oil seal for fluidly sealing the exit of said motor shaft from said oil reservoir;

an accumulator fluidly connected to said oil reservoir; and a diaphragm separating said accumulator into first and second fluid-tight compartments, said first compartment fluidly connected to said oil reservoir for supplying oil to, and receiving oil from, said oil reservoir, said second compartment being adapted to apply a selected pressure to said diaphragm thereby transferring said pressure in said second compartment to said oil in said first compartment and to said oil reservoir, said selected pressure being greater than the pressure exerted on the external surface of said pumping system when said pumping system is submersed.

2. The pumping system of claim 1 further including a pressure switch or pressure transmitter for remotely detecting the pressure inside said oil reservoir.

3. The pumping system of claim 2 wherein said pressure switch or pressure transmitter is responsive to a change of pressure within said oil reservoir.

4. The pumping system of claim 3 wherein said pressure switch or pressure transmitter is adapted to alarm and/or remove power from said electric motor when a selected low pressure is detected by said pressure switch or pressure transmitter.

5. The pumping system of claim 1 further including an air purge directly to said electric motor for maintaining a selected pressure within said motor housing whether said motor is hot or cold.

6. The pumping system of claim 5 wherein said selected pressure is greater than said pressure external to said motor.

7. The pumping system of claim 1 wherein said accumulator is located internal to said pump.

8. The pumping system of claim 7 wherein said accumulator is located in said oil reservoir.

9. A submersible pumping system comprising:

an electric motor enclosed in a sealed housing and having a motor shaft;

an oil reservoir rigidly connected to said motor housing and sealingly surrounding a portion of said motor shaft;

a pump rigidly attached to said oil reservoir, said pump including an intake port for receiving a fluid therethrough, an impeller rigidly attached to said motor shaft for rotation therewith and a discharge port for discharging said fluid therethrough;

a first oil seal for fluidly sealing the entrance of said motor shaft into said oil reservoir;

a second oil seal for fluidly sealing the exit of said motor shaft from said oil reservoir;

an accumulator, located external to said pump, fluidly connected to said oil reservoir; and a diaphragm separating said accumulator into first and second fluid-tight compartments, said first compartment being fluidly connected to said oil reservoir for supplying oil to, and receiving oil from, said oil reservoir, said second compartment being adapted to apply a selected pressure to said diaphragm thereby transferring said pressure in said second compartment to said oil in said first compartment and to said oil reservoir, said selected pressure being greater than the pressure exerted on the external surface of said pumping system when said pumping system is submersed.

* * * * *